United States Patent [19]

Pönsgen

[11] 4,006,308

[45] Feb. 1, 1977

[54] LOUDSPEAKER ARRANGEMENT

[76] Inventor: Karl Otto Pönsgen, Connollystrasse 14, 8 Munich 40, Germany

[22] Filed: July 22, 1975

[21] Appl. No.: 598,158

[30] Foreign Application Priority Data

July 25, 1974 Germany ..... 2435944

[52] U.S. Cl. ..... 179/1 E; 181/147; 181/153; 181/154; 181/155

[51] Int. Cl.² ..... H04R 1/20

[58] Field of Search ..... 179/1 E; 181/147, 148, 181/153, 154, 144, 145, 146, 199; D26/14 G

[56] References Cited

UNITED STATES PATENTS

| | | | |
|---|---|---|---|
| 2,544,742 | 3/1951 | Volf | 181/145 |
| 2,824,617 | 2/1958 | Roulet | 181/145 |
| 2,915,588 | 12/1959 | Bose | 179/1 E |
| 3,360,072 | 12/1967 | Carlsson | 179/1 E |
| 3,590,942 | 7/1971 | Globa | 181/146 |
| 3,818,138 | 6/1974 | Sperrazza, Jr. | 179/1 E |
| D211,361 | 6/1968 | Moore | D26/14 G |
| D226,567 | 3/1973 | Sioles et al. | D26/14 G |
| D227,478 | 6/1973 | Ekdahl et al. | D26/14 G |

FOREIGN PATENTS OR APPLICATIONS

| | | | |
|---|---|---|---|
| 1,199,441 | 12/1959 | France | 179/1 E |

*Primary Examiner*—George G. Stellar
*Attorney, Agent, or Firm*—Michael J. Striker

[57] ABSTRACT

A loudspeaker arrangement for radiating sound signals in an improved acoustical dispersion pattern includes mounting a plurality of speakers on a loudspeaker enclosure having a vertical axis. The speakers radiate sound signals in at least four directions normally to the vertical axis in the circumambient region of the enclosure, and at least one of the speakers is mounted in an upper region of the loudspeaker enclosure and radiates sound signals having at least a sound signal component in the vertical direction so that the high-frequency signal response above the enclosure is improved.

14 Claims, 8 Drawing Figures

LOUDSPEAKER ARRANGEMENT

BACKGROUND OF THE INVENTION

The present invention relates to a high-fidelity loudspeaker arrangement, and more particularly to a loudspeaker arrangement having an acoustically-improved sound radiation or dispersion pattern, especially for high frequency signals.

In the prior art, multi- or omni-directional speaker arrangements are known. One such high-fidelity arrangement mounts four tweeters, i.e., a type of speaker responsive to the higher acoustic frequencies which is used for reproducing sounds of high pitch, about a vertical axis of an upright enclosure, and a single woofer, i.e., a type of speaker responsive to the lower acoustic frequencies, on the enclosure below the aforementioned grouping of four tweeters. Such an arrangement, however, achieves a sound distribution pattern only in the circumambient region of the enclosure which surrounds the vertical axis.

A significant problem in achieving a 360° sound dispersion pattern is that of the frequencies of the sound signals to be reproduced. The higher the frequencies, the narrower will be the dispersion angle or width of the radiating sound waves. In order to improve the distribution of such high-frequency and low dispersion angle sound waves, hemispherically-shaped radiators having relatively large dispersion angles are utilized. However, the practical limitations of the design of the hemispherically-shaped radiators only give a maximum 180° zone coverage up to frequencies of 4,000 Hz. At frequencies above 4,000 Hz, the size of the dispersion angle decreases.

Although the known high-fidelity arrangements have achieved a more or less uniform acoustical pattern for high-frequency signals without the occurrence of holes or regions of silence where the sound waves cancel out the effects of each other, the known prior art arrangements have not adequately eliminated such holes in planes other than the horizontal plane or in zones other than about the vertical axis of the loudspeaker enclosure. The quality of the sound reproduction is thus impaired for a listener.

The best acoustical sound pattern is one that creates a sound illusion that is free, open, and expansive. Such natural concert-hall sound realism is difficult to achieve with conventional loudspeaker arrangements. The sounds of the various musical instruments are not all specifically directed to a listener, but rather reach the listener through indirect means. For example, the sounds, and especially the high-frequency sounds, are directed upwardly to bounce off the walls and the ceiling of the concert hall so that the music fills the entire room. The conventional loudspeaker arrangements have attempted to design systems which can provide such sound realism; however, they are extremely costly and require a great deal of space.

SUMMARY OF THE INVENTION

Accordingly, it is the general object of the present invention to overcome the disadvantages of the prior art.

More particularly, it is the object of the present invention to improve the acoustical dispersion pattern of sound signals to be reproduced.

Another object of the present invention is to provide a loudspeaker arrangement which is inexpensive to manufacture and compact in its construction.

An additional feature of the present invention is to improve the high-frequency response of a loudspeaker arrangement not only in the circumambient region of a loudspeaker enclosure but also above the same.

In keeping with these objects and others which will become apparent hereinafter, one feature of the invention resides in providing a plurality of speakers and mounting them on a loudspeaker enclosure having a vertical axis. A set of at least four first-type speakers, i.e., either a tweeter having a response characteristic responsive to the higher acoustic frequencies and/or a combination tweeter-mid-range speaker having a combined response characteristic responsive to both the high and the middle acoustic frequency ranges, is mounted so as to radiate sound signals in at least four directions orthogonal to the vertical axis of the enclosure. One of the first-type speakers is mounted in an upper region of the enclosure and radiates sound signals having at least a signal component in the vertical direction.

The presence of the feature of the upwardly-directed sound signal component overcomes the disadvantages of the prior art noted above and achieves the aforementioned objects in a simple and reliable manner. The present invention achieves a full, free, open and expansive sound illusion in both the vertical and the horizontal directions and over the entire acoustical spectrum of frequencies, and especially over the critical high-frequency range. If hemispherically-shaped speakers are used, a more natural rendition of the original sound will be reproduced, and thus a closer approximation to the original sound-producing event will be achieved.

Performance tests have been conducted on the present loudspeaker arrangement and have indicated that only very slight and acceptable level fluctuations occur in the horizontal as well as in the vertical directions. Hence, since the improvement in the quality of the sound reproduction achieved by the present high-fidelity arrangement is so great, the arrangement can be advantageously used in all types of speaker systems, such as monophonic, and preferably in stereophonic or quadrophonic systems.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
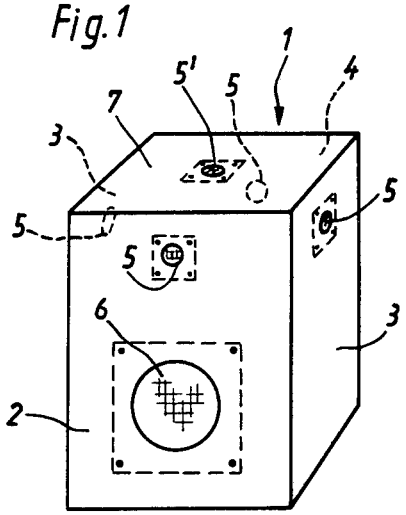
FIG. 1 is a diagrammatic perspective view of a rectangular parallelopiped-shaped enclosure of an embodiment according to the present invention.

Referring jointly to the embodiments illustrated in FIGS. 1–4 of the drawing, it will be seen that reference numeral 1 identifies a rectangular parallelopiped-shaped loudspeaker enclosure. The enclosure 1 has a front wall 2, a back wall 4 and a pair of side walls 3.

The arrangement further comprises a plurality of speakers including a first-type speaker 5 that is preferably a hemispherically-shaped speaker which is respectively mounted in an upper region of the enclosure 1 on each of its front 2, back 4 and side walls 3. The hemispherically-shaped first-type speaker 5 may be a tweeter having an acoustic characteristic responsive only to the higher acoustic sound frequencies to be reproduced or may be a combination tweeter-mid-range speaker having an acoustic characteristic responsive to the higher and the mid-range sound frequencies of the frequency spectrum.

Each of the four first-type speakers 5 are equi-angularly spaced on the enclosure 1 about an upright and preferably a substantially vertical axis thereof, so that sound signals radiate in at least four mutually perpendicular directions orthogonally to the axis. Sound is thus radiated into the circumambient region of the enclosure 1 surrounding the vertical axis.

The enclosure 1 has a top wall or cover 7 upon which another first-type speaker 5' is mounted. In this embodiment, a substantial portion of the sound signal emanating for speakers' is directed vertically, i.e., normally with respect to the cover 7.

The loudspeaker arrangement further comprises a second-type speaker, i.e., a woofer 6 which is responsive to the lower or bass frequencies of the acoustic spectrum. This woofer 6 is mounted in a lower region of the enclosure and, in FIG. 1, is mounted on the front wall 2.

Figure 2:
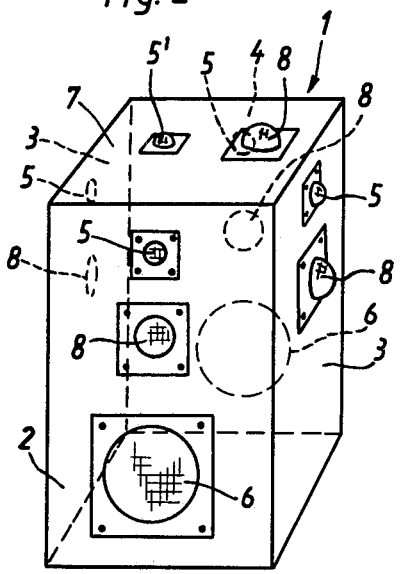
FIG. 2 is a diagrammatic perspective view of a rectangular parallelopiped-shaped enclosure of another embodiment according to the present invention.

Referring specifically to FIG. 2, it will be understood that like numerals identify like parts. This embodiment is different from the embodiment of FIG. 1 in two respects.

First, a third-type speaker, i.e., a mid-range speaker 8, is separately mounted on each of the top 7, front 2, back 4 and side walls 3 of the enclosure 1. Mid-range speakers 8, preferably hemispherically-shaped, are responsive to sound signals having frequencies in the middle range of the acoustic spectrum and are mounted individually adjacent to the first-type speakers 5, 5'. Secondly, an additional second-type speaker, or woofer 6, is mounted on the back wall 4 directly behind the first-mentioned woofer 6 mounted on the front wall 2.

Figure 3:
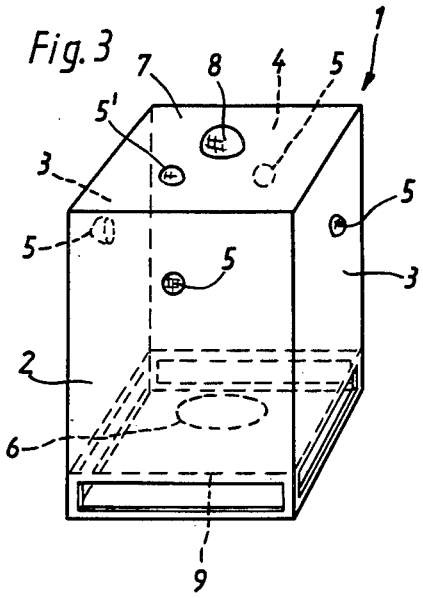
FIG. 3 is a diagrammatic perspective view of a rectangular parallelopiped-shaped enclosure of still another embodiment according to the present invention.

Referring specifically to FIG. 3, it will be understood that like numerals again identify like parts. This embodiment is different from the previous embodiment illustrated in FIG. 2 in that only one of the third-type speakers 8 is mounted on the enclosure 1, in this case, on the top wall 7. Moreover, the woofer 6 is not mounted on the front or back walls of the enclosure 1, but on a partition wall 9 which is parallel and upwardly spaced from the base wall of the enclosure 1. In this embodiment, the low-frequency sound signals are directed downwardly and radiate from the enclosure 1 by means of openings provided in the lower region of the enclosure.

Figure 4:
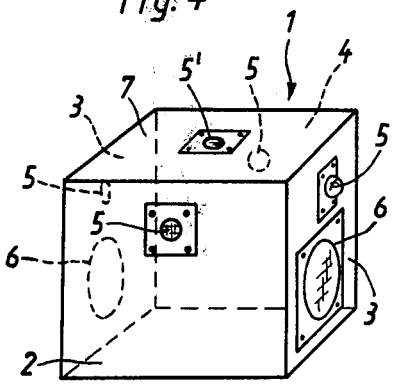
FIG. 4 is a diagrammatic perspective view of a rectangular parallelopiped-shaped enclosure of still a further embodiment according to the present invention.

Referring specifically to FIG. 4, like numerals again identify like parts. The embodiment of FIG. 4 is different from that of FIG. 1 in that the woofers 6 are respectively mounted on the side walls 3 below the first-type speakers 5, instead of on the front wall 2.

Figure 5:
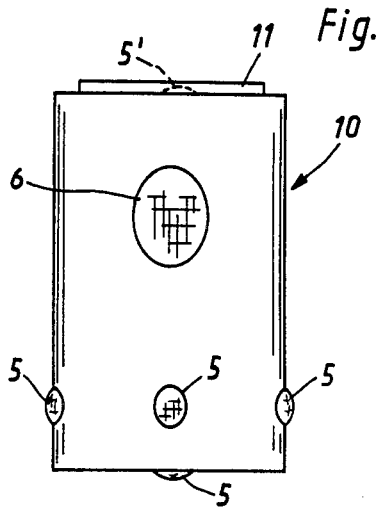
FIG. 5 is a diagrammatic perspective view of a cylindrically-shaped enclosure of yet another embodiment according to the present invention.

Now referring to the embodiment of FIG. 5, it will be seen that reference numeral 10 identifies a cylindrically-shaped enclosure having a vertical axis and a top, base and circumferential wall. Four first-type speakers 5 are equi-angularly spaced about the axis at the same height above the base wall in the lower region of the enclosure 10. Two second-type speakers or woofers 6 are mounted on opposite sides of the axis in the upper region of the enclosure 10. Two identical first-type speakers 5', 5 are respectively mounted on the top and base walls of the enclosure 10. A suspension arrangement 11 is connected to the top wall in order to permit the cylindrical enclosure 10 to be hung from a support.

In all of the embodiments already mentioned, a substantial and major portion of the sound signal is directed upwardly. That is, first-type speaker 5' is separately mounted and radiates sound signals above the respective enclosure.

Figure 6:
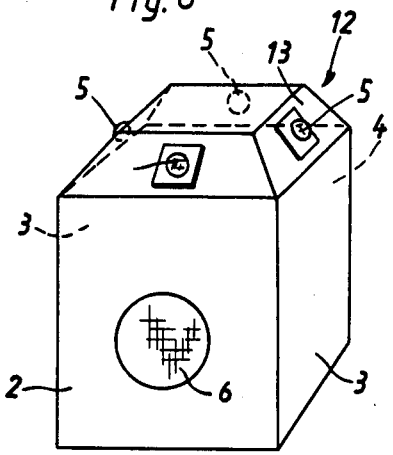
FIG. 6 is a diagrammatic perspective view of a truncated pyramidally-shaped enclosure of yet a further embodiment according to the present invention.
Figure 7:
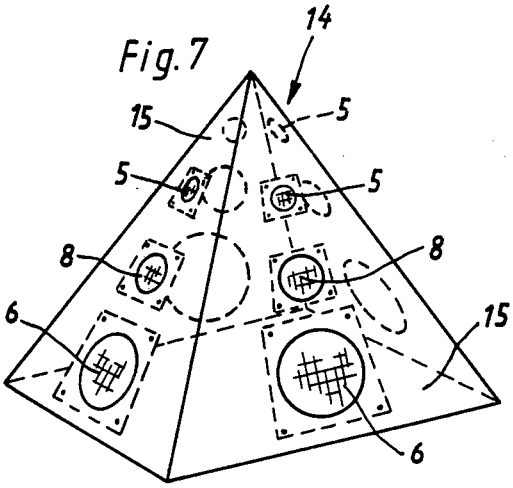
FIG. 7 is a diagrammatic perspective view of a pyramidally-shaped enclosure of a still further embodiment according to the present invention.
Figure 8:
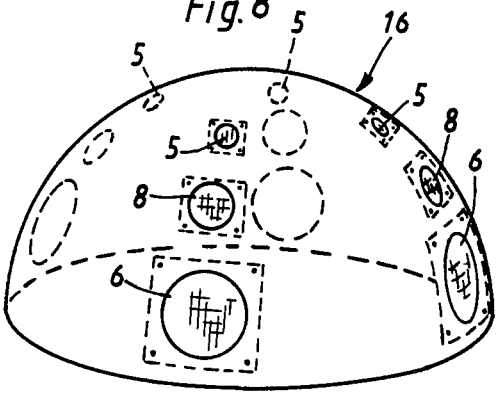
FIG. 8 is a diagrammatic perspective view of a hemispherically-shaped enclosure of yet another embodiment according to the present invention.

In the embodiments of FIGS. 6–8, no separate first-type speaker 5' is mounted on a top wall or cover, rather the enclosure is shaped so as to have wall portions which are inclined with respect to its vertical axis, and at least one first-type speaker is mounted on one of these inclined walls. As will be shown herein, the sound being radiated from the first-type speaker 5 mounted on an inclined wall has a component in the vertical direction, although it will be appreciated that it is of a relatively lesser magnitude as compared with the portion of the vertical component described in connection with FIGS. 1–5.

Referring to FIG. 6, reference numeral 12 identifies a truncated-pyramidally-shaped enclosure 12 having a cubic parallelopiped-shaped lower region, and an upper truncated pyramidal region comprising the inclined walls 13. Four first-type speakers 5 are respectively mounted on the four inclined walls 13 which are each preferably inclined at identical angles with respect to the vertical axis of the enclosure 12. A woofer 6 is mounted on front wall 2.

It will be seen from this construction that each of the first-type speakers 5 radiates sound signals having both a horizontal and a vertical signal component. As one varies the pre-selected angle of inclination of the inclined walls 13, the corresponding signal component in the vertical direction will be likewise changed.

Similarly, FIG. 7 illustrates another embodiment having inclined wall portions 15 which define a pyramidally-shaped enclosure 14. The enclosure 14 preferably has a rectangular base wall. Various combinations of first-, second- and third-type speakers may be provided on the inclined walls 15 and, in FIG. 7, four of each type of speaker are shown mounted on the respective four inclined walls 15 of the enclosure 14. As shown, first-type speaker 5 is mounted in the upper region, second-type speaker 6 is mounted in the lower region, and third-type speaker 8 is mounted intermediate the first- and second-type speakers on the walls 15. Any one of the aforementioned speakers may be omitted; it is only necessary that at least one of the first-type speakers 5 be provided in the upper region of the enclosure 14 so as to radiate a sound signal having a component at least in the vertical direction.

Referring finally to FIG. 8, reference numeral 16 identifies a hemispherically-shaped enclosure having a plurality of first-, second- and third-type speakers mounted thereon. Depending upon the radius of curvature selected for the enclosure 16, the first-type speakers 5 will have a differently-sized component in the vertical direction. As clearly shown in FIG. 8, the first-type speakers 5 are more strongly inclined with respect to the vertical axis than either the mid-range speakers 8 or the woofers 6.

In the claims that follow the term "substantially vertical" axis is used. It should be understood that this term is intended to mean that not only can the enclosure be oriented to have a perfectly vertical axis but also that the enclosure can be tilted, even to a considerable degree, without changing the spirit of the invention.

It will be understood that each of the elements described above, or two or more together, may also find a useful application in other types of constructions differing from the types described above.

While the invention has been illustrated and described as embodied in a loudspeaker arrangement, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A loudspeaker arrangement comprising an enclosure having a vertical axis and walls including a top wall; and a plurality of speakers including first-type speakers and at least one another type speaker, said first-type speakers having a high-frequency acoustic characteristic and said another type speaker having another frequency acoustic characteristic, said speakers having a high-frequency acoustic characteristic being mounted on said enclosure equi-angularly spaced from each other about said axis and so as to radiate sound signals in at least four directions orthogonal to said axis and at least one additional speaker having a high-frequency acoustic characteristic being mounted on said top wall of said enclosure and radiating sound signals only in the vertical direction, said speakers being so arranged as to radiate axis-symmetrically sound signals of different frequencies radiating by said speakers and to produce a uniform mixture of said sound signals.

2. A loudspeaker arrangement as defined in claim 1, wherein said enclosure has a cylindrical configuration and has a top, base and circumferential wall; and wherein said four first-type speakers are equiangularly mounted on said circumferential wall, and wherein another first-type speaker is mounted on said base wall; and further comprising an additional second-type speaker, both said additional second-type speaker and said one second-type speaker also being mounted on said circumferential wall.

3. A loudspeaker arrangement as defined in claim 1, further comprising an other speaker having low frequency acoustic sound characteristic and radiating sound signal in the vertical direction.

4. A loudspeaker arrangement as defined in claim 3, wherein said other speaker is so arranged as to radiate sound signal upwardly.

5. A loudspeaker arrangement as defined in claim 1, further comprising a further speaker having a mid-range acoustic characteristic, said further speaker being associated with said additional speaker and radiating sound signal likewise in the vertical direction.

6. A loudspeaker arrangement as defined in claim 5, wherein a further speaker having a mid-range acoustic characteristic is combinated with each speaker having a high frequency acoustic characteristic and radiating sound signal in direction orthogonal to said axis.

7. A loudspeaker arrangement as defined in claim 5, wherein said additional speaker having high frequency acoustic characteristic and said further speaker having midrange acoustic characteristic are combined in a speaker having combined acoustic characteristic in the high and mid-range frequency regions.

8. A loudspeaker arrangement as defined in claim 1, wherein four of said first-type speakers are each equiangularly spaced on said enclosure about said axis; and wherein said plurality of speakers further includes at least one second-type speaker having a low-frequency acoustic sound characteristic.

9. A loudspeaker arrangement as defined in claim 8, wherein said enclosure has a rectangular parallelopiped configuration and has a top, front, rear and a pair of side walls; and wherein said four first-type speakers are respectively mounted on said front, rear and side walls and said one first-type speaker is mounted on said top wall.

10. A loudspeaker arrangement as defined in claim 9, wherein said plurality of speakers further includes a plurality of third-type speakers having a mid-range acoustic sound characteristic, each of said third-type speakers being respectively mounted on said top, front, rear and side walls.

11. A loudspeaker arrangement as defined in claim 9, wherein said enclosure has a base wall and a partition wall upwardly spaced from said base wall, and wherein said one second-type speaker is mounted on said partition in a lower region of said enclosure; and wherein said plurality of speakers includes a thrid-type speaker mounted on said top wall.

12. A loudspeaker arrangement as defined in claim 9; and further comprising an additional second-type speaker, both said additional second-type speaker and said one second-type speaker being mounted on said side walls.

13. A loudspeaker arrangement as defined in claim 9, wherein said one second-type speaker is mounted on said front wall.

14. A loudspeaker arrangement as defined in claim 13; and further comprising an additional second-type speaker mounted on said rear wall.

* * * * *